US006018639A

United States Patent [19]

Genovese

[11] Patent Number: 6,018,639

[45] Date of Patent: Jan. 25, 2000

[54] MAGNETIC SLEEVE FOR NON-INTERACTIVE AGITATED MAGNETIC BRUSH DEVELOPMENT

[75] Inventor: Frank C. Genovese, Fairport, N.Y.

[73] Assignee: Xerox Corporation, Stamford, Conn.

[21] Appl. No.: 09/218,671

[22] Filed: Dec. 22, 1998

[51] Int. Cl.[7] ..... G03G 15/09

[52] U.S. Cl. ..... 399/277; 399/276

[58] Field of Search ..... 399/222, 258, 399/261, 265, 266, 267, 270, 272, 276, 277, 278, 282, 290

[56] References Cited

U.S. PATENT DOCUMENTS

| | | | |
|---|---|---|---|
| 3,113,042 | 12/1963 | Hall | 118/637 |
| 3,592,166 | 7/1971 | Wu | 118/637 |
| 3,900,001 | 8/1975 | Fraser et al. | 118/637 |
| 3,906,121 | 9/1975 | Fraser et al. | 427/18 |
| 4,004,508 | 1/1977 | Rarey et al. | 101/114 |
| 4,067,295 | 1/1978 | Parker et al. | 118/653 |
| 4,235,549 | 11/1980 | Eisbein et al. | 399/271 |
| 5,227,848 | 7/1993 | Robinson et al. | 399/53 |
| 5,826,151 | 10/1998 | Genovese | 399/277 |

*Primary Examiner*—William Royer
*Assistant Examiner*—Hoang Ngo
*Attorney, Agent, or Firm*—Lloyd F. Bean, II

[57] ABSTRACT

A development system is disclosed including a developer roll adapted for depositing developer material on an imaging surface having an electrostatic latent image thereon. The development system which includes a developer roll with a magnetic sleeve having a static magnetic field pattern for transporting developer material to a development zone. In operation the stationary magnetically patterned sleeve holds a thin well-defined blanket of magnetic developer on the sleeve surface. Magnetic assembly rotates and thereby generating a tangential magnetic field to move the developer blanket along the surface of sleeve; The developer blanket passes over zones on sleeve where developer material is picked up, self metering, mixing, blanket homoginization, tribo charging and developer transport occurs. The developer blanket moves to the development zone which is defined by a planar portion on the sleeve; parallel and adjacent to the imaging surface whereupon the blanket is compressed. Agitation generated by the rotating magnetic assembly dislodges toner particles from the carrier beads and an AC field is applied to the sleeve to aid in the formation of a toner cloud in the development zone for transporting toner to the imaging surface by the development fields.

13 Claims, 7 Drawing Sheets

MAGNETIC SLEEVE FOR NON-INTERACTIVE AGITATED MAGNETIC BRUSH DEVELOPMENT

BACKGROUND OF THE PRESENT INVENTION

The invention relates generally to an electrophotographic printing machine and, more particularly, to a development system which includes a developer roll with a magnetic sleeve having a static magnetic field pattern for transporting developer material to a development zone; and a multiple magnet that generates a magnetic field that moves developer material along the sleeve and agitate developer material in the development zone in order to produce a charged toner cloud intended for the non-interactive development of latent electrostatic images.

INCORPORATED BY REFERENCE

The following are incorporated for their teachings, Issued U.S. Pat. No. 5,826,151 entitled "APPARATUS AND METHOD FOR NON-INTERACTIVE AGITATED MAGNETIC BRUSH DEVELOPMENT", U.S. Appl. Ser. No. 08/886,166 entitled "MAGNETIC SLEEVE FOR NON-INTERACTIVE AGITATED MAGNETIC BRUSH DEVELOPMENT" and Issued U.S. Pat. No. 5,781,837 entitled "MAGNETIC FLEXIBLE BELT FOR NON-INTERACTIVE AGITATED MAGNETIC BRUSH DEVELOPMENT".

Co-pending application U.S. Appl. Ser. No. (D/98546), filed concurrently herewith, entitled "MAGNETIC SLEEVE FOR NON-INTERACTIVE AGITATED MAGNETIC BRUSH DEVELOPMENT".

Generally, an electrophotographic printing machine includes a photoconductive member which is charged to a substantially uniform potential to sensitize the surface thereof. The charged portion of the photoconductive member is exposed to an optical light pattern representing the document being produced. This records an electrostatic latent image on the photoconductive member corresponding to the informational areas contained within the document. After the electrostatic latent image is formed on the photoconductive member, the image is developed by bringing a developer material into proximal contact therewith. Typically, the developer material comprises toner particles adhering triboelectrically to carrier granules. The toner particles are attracted to the latent image from the carrier granules and form a powder image on the photoconductive member which is subsequently transferred to a copy sheet. Finally, the copy sheet is heated or otherwise processed to permanently affix the powder image thereto in the desired image-wise configuration.

In the prior art, both interactive and non-interactive development has been accomplished with magnetic brushes. In typical interactive embodiments, the magnetic brush is in the form of a rigid cylindrical sleeve which rotates around a fixed assembly of permanent magnets. In this type development system, the cylindrical sleeve is usually made of an electrically conductive, non-ferrous material such as aluminum or stainless steel, with its outer surface textured to improve developer adhesion. The rotation of the sleeve transports magnetically adhered developer through the development zone where there is direct contact between the developer brush and the imaged surface, and toner is stripped from the passing magnetic brush filaments by the electrostatic fields of the image.

Non-interactive development is most useful in color systems when a given color toner must be deposited on an electrostatic image without disturbing previously applied toner deposits of a different color or cross-contaminating the color toner supplies.

U.S. Pat. No. 5,409,791 to Kaukeinen et al. describes a non-interactive magnetic brush development method employing a rotating magnetic multiple core within a passive sleeve to provide a regular matrix of surface gradients that attract magnetic carrier to the sleeve. As the core rotates in one direction within the sleeve, the magnetic field lines rotate in the opposite sense at the surface of the sleeve, causing the brush filaments to follow suit. The collective tumbling action of the filaments transports bulk developer material along the sleeve surface. The mechanical agitation inherent in the rotating filaments dislodges toner particles from the carrier beads that form the brush filaments making them available for transport across a gap to the photoreceptor surface under the influence of the proximal development fields of the image. U.S. Pat. No. 5,409,791 is hereby incorporated by reference.

It has been observed that the magnetic brush height formed by the developer mass in the magnetic fields on the sleeve surface in this type development system is periodic in thickness and statistically noisy as a result of complex carrier bead agglomeration and filament exchange mechanisms that occur during operation. As a result, substantial clearance must be provided in the development gap to avoid photoreceptor interactions through direct physical contact, so that the use of a closely spaced developer bed critical to high fidelity image development is precluded.

The magnetic pole spacing cannot be reduced to an arbitrarily small size because allowance for the thickness of the sleeve and a reasonable mechanical clearance between the sleeve and the rotating magnetic core sets a minimum working range for the magnetic multiple forces required to both hold and tumble the developer blanket on the sleeve. Since the internal pole geometry defining the spatial wavelength of the tumbling component also governs the magnitude of the holding forces for the developer blanket at any given range, there is only one degree of design freedom available to satisfy the opposing system requirements of short spatial wavelength and strong holding force. Reducing the developer blanket mass by supply starvation has been found to result in a sparse brush structure without substantially reducing the brush filament lengths or improving the uneven length distribution.

SUMMARY OF THE INVENTION

The present invention obviates the problems noted above by utilizing a development system including a developer roll adapted for depositing developer material on an imaging surface having an electrostatic latent image thereon. The development system which includes a developer roll with a magnetic sleeve having a static magnetic field pattern for transporting developer material to a development zone. In operation the stationary magnetically patterned sleeve holds a thin well-defined blanket of magnetic developer on the sleeve surface. Magnetic assembly rotates and thereby generating a tangential magnetic field to move the developer blanket along the surface of sleeve; The developer blanket passes over zones on sleeve where developer material is picked up, self metering, mixing, blanket homoginization, tribo charging and developer transport occurs. The developer blanket moves to the development zone which is defined by a planar portion on the sleeve; parallel and adjacent to the imaging surface whereupon the blanket is compressed. Agitation generated by the rotating magnetic assembly dislodges toner particles from the carrier beads and an AC field is applied to the sleeve to aid in the formation of a toner cloud in the development zone for transporting toner to the imaging surface by the development fields.

DESCRIPTION OF THE INVENTION

Figure 1:
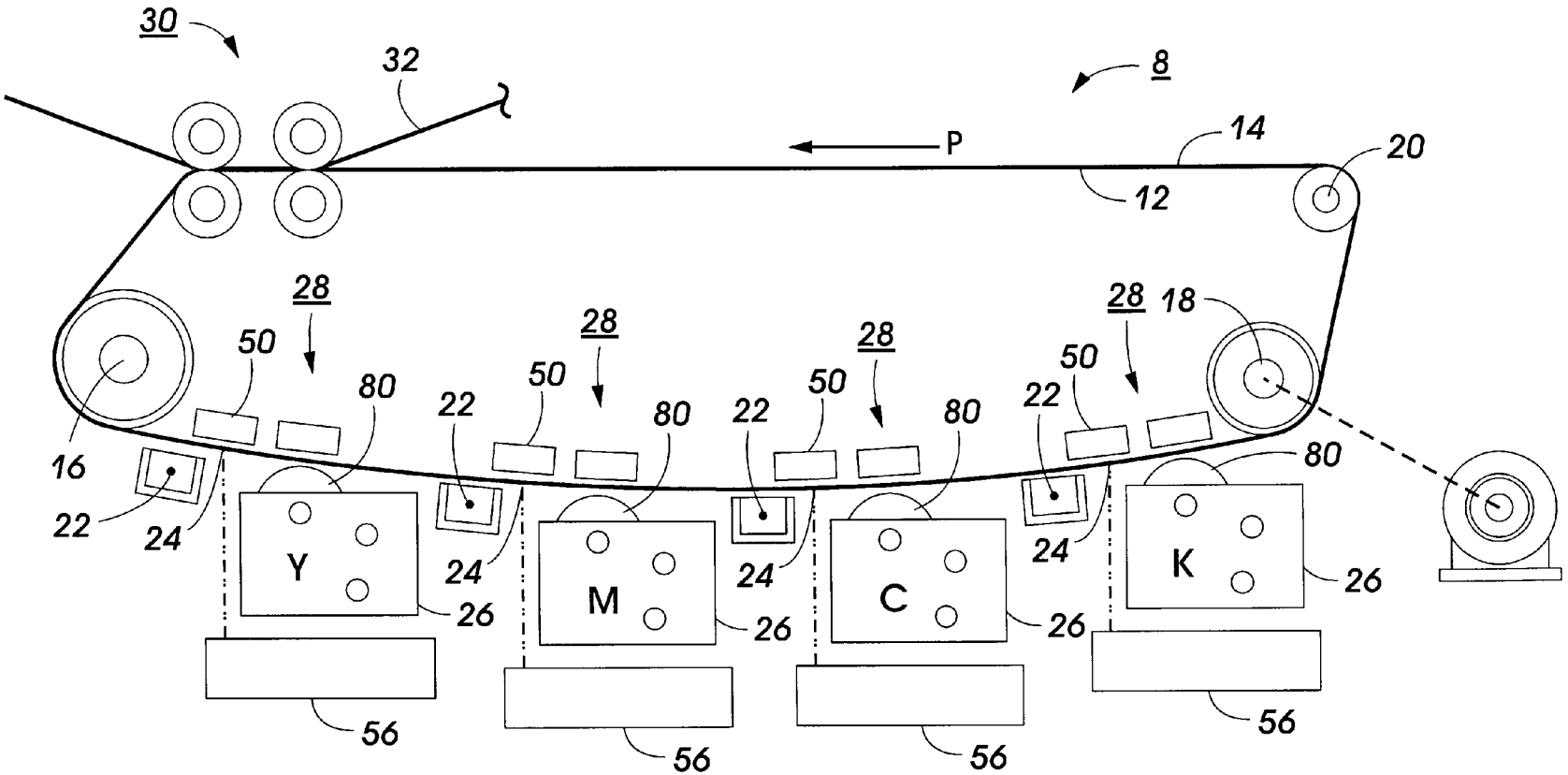
FIG. 1 is a side view, in section, of a four color xerographic reproduction machine incorporating the non-interactive magnetic brush developer of the present invention.

Referring to FIG. 1 of the drawings, there is shown a xerographic type reproduction machine 8 incorporating an embodiment of the non-interactive agitated magnetic brush of the present invention, designated generally by the numeral 80. Machine 8 has a suitable frame (not shown) on which the machine xerographic components are operatively supported. As will be familiar to those skilled in the art, the machine xerographic components include a recording member, shown here in the form of a rotatable photoreceptor 12. In the exemplary arrangement shown, photoreceptor 12 comprises a belt having a photoconductive surface 14. The belt is driven by means of a motorized linkage along a path defined by rollers 16, 18 and 20, and those of transfer assembly 30, the direction of movement being counter-clockwise as viewed in FIG. 1 and indicated by the arrow marked P. Operatively disposed about the periphery of photoreceptor 12 are charge corotrons 22 for placing a uniform charge on the photoconductive surface 14 of photoreceptor 12; exposure stations 24 where the uniformly charged photoconductive surface 14 constrained by positioning shoes 50 is exposed in patterns representing the various color separations of the document being generated; development stations 28 where the latent electrostatic image created on photoconductive surface 14 is developed by toners of the appropriate color; and transfer and detack corotrons (not shown) for assisting transfer of the developed image to a suitable copy substrate material such as a copy sheet 32 brought forward in timed relation with the developed image on photoconductive surface 14 at image transfer station 30. In preparation for the next imaging cycle, unwanted residual toner is removed from the belt surface at a cleaning station (not shown).

Following transfer, the sheet 32 is carried forward to a fusing station (not shown) where the toner image is fixed by pressure or thermal fusing methods familiar to those practicing the electrophotographic art. After fusing, the copy sheet 32 is discharged to an output tray.

At each exposure station 24, photoreceptor 12 is guided over a positioning shoe 50 so that the photoconductive surface 14 is constrained to coincide with the plane of optimum exposure. A laser diode raster output scanner (ROS) 56 generates a closely spaced raster of scan lines on photoconductive surface 14 as photoreceptor 12 advances at a constant velocity over shoe 50. A ROS includes a laser source controlled by a data source, a rotating polygon mirror, and optical elements associated therewith. At each exposure station 24, a ROS 56 exposes the charged photoconductive surface 14 point by point to generate the latent electrostatic image associated with the color separation to be generated. It will be understood by those familiar with the art that alternative exposure systems for generating the latent electrostatic images, such as print bars based on liquid crystal light valves and light emitting diodes (LEDs), and other equivalent optical arrangements could be used in place of the ROS systems such that the charged surface may be imagewise discharged to form a latent image of the appropriate color separation at each exposure station.

Developer assembly 26 includes a developer housing 65 in which a toner dispensing cartridge 66 is rotatably mounted so as to dispense toner particles downward into a sump area occupied by the auger mixing and delivery assembly 70 of the present invention. Assembly 70 includes rotatably mounted augers 72 and 74 which conveys developer material to donor roll 80.

Continuing with the description of operation at each developing station 24, donor roll 80 is disposed in predetermined operative relation to the photoconductive surface 14 of photoreceptor 12, the length of donor roll 80 being equal to or slightly greater than the width of photoconductive surface 14, with the functional axis of donor roll 80 parallel to the photoconductive surface and oriented at a right angle with respect to the path of photoreceptor 12. Advancement of donor roll 80 carries the developer blanket 82 into the development zone in proximal relation with the photoconductive surface 14 of photoreceptor 12 to develop the latent electrostatic image therein.

A suitable controller is provided for operating the various components of machine 8 in predetermined relation with one another to produce full color images.

Figure 7:
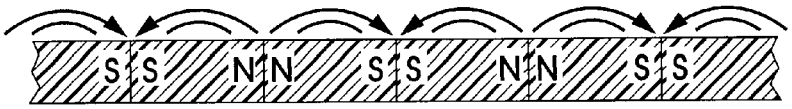
FIGS. 7–11 are alternative embodiments of the sleeve incorporated in the donor roll of the present invention.

Further details of the construction and operation of donor roll 80 of the present invention is provided below referring to FIGS. 2–5. In the present invention sleeve 75 is fabricated with a surface of magnetically hard material that has been magnetized in a short spatial wavelength-pattern chosen to saturate at the desired thickness of developer blanket 82. Preferably, sleeve 75 is composed of a layer between 20 microns and 2 mm in thickness containing up to 80% by volume of neodymium iron boron or samarium cobalt compounds, or ceramic barium or strontium ferrite powder with a mean particle size of between 1 and 50 microns evenly dispersed in a stable binder. The magnetic layer can be fabricated in the form of a self-supporting tube with a rigid binder as shown in FIG. 7, or applied in the form of a coating or layer on either the inner or outer surface of a rigid tubular substrate as illustrated in FIGS. 8–11. Since the developer material is in direct contact with the surface of sleeve 75, the spatial magnetization wavelength can be very short, holding a developer blanket 82 thickness on the order of ¼ to ½ the spatial wavelength. The lower limit is expected to be on the order of 3 or 4 times the developer bead size. The preferred blanket thickness is between 0.1 and 1 mm.

It can be appreciated that since the blanket holding field and the agitation field are derived independently, the arrangement of the present invention provides a degree of engineering design freedom not available in previous art configurations. High resolution development in which image details in the range of 40 microns are accurately produced has been found to require a narrow effective development gap on the order of 200 microns. The absence of physical interactions requires that the magnetic filament lengths and therefore the spatial wavelength be as short as possible consistent with a developer blanket mass that can deliver an adequate supply of toner. It is well known that dipole and higher multiple magnetic fields fall off rapidly with distance from the magnetic source. The present invention places the developer material in direct contact with the source in the form of a magnetic pattern on the surface of the sleeve. Thus the distance is minimum and the forces holding the developer blanket are stronger than for any other configuration with the same spatial wavelength and source strength. Since agitation is provided by a separate AC field source, formulation of the magnetic component of the transport member can be tailored as needed for optimum blanket characteristics. The thickness and magnetic loading of the transport member can both be chosen independently over a range of values, from containing a low percentage of magnetic material to comprising approximately 65% by volume, and the entrained magnetic component in the transport member can be chosen from several candidate materials.

Figure 8:
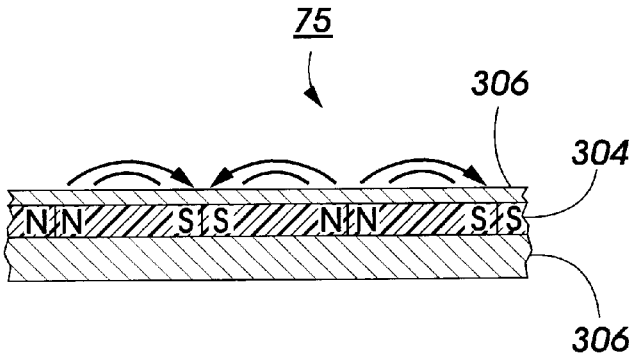
Figure 9:
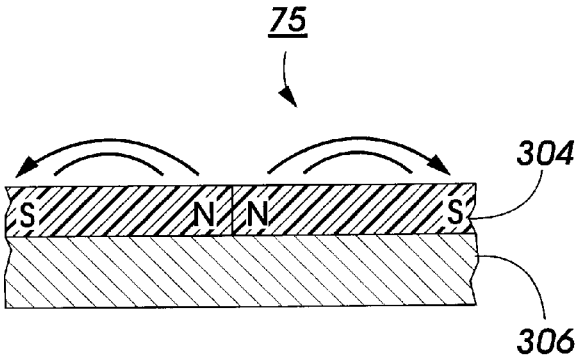
Figure 10:
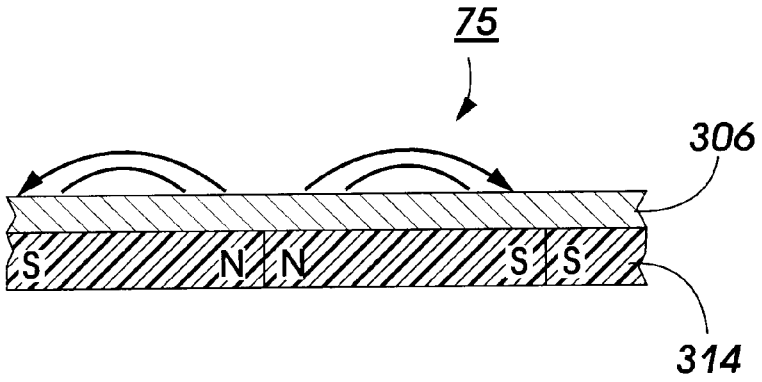
Figure 11:
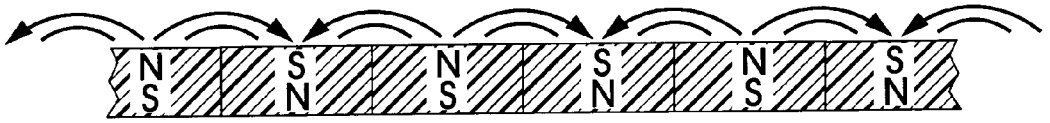

The magnetic material of the sleeve must be magnetically hard enough to remain permanently magnetized in the alternating applied field. This means that the magnetic material chosen should have a high coercivity (resistance to demagnetization). However, to maximize agitation, the applied fields should cause major local perturbations in the field directions at the sleeve's surface implying that the fields due to the magnetic pattern of the member itself be made as weak as is consistent with a well-behaved developer blanket. Since the intrinsic coercivity and magnetic remanance or "strength" of a given magnetic material are in a fixed relationship, one way of tailoring effective magnetic strength without reducing coercivity is to dilute the magnetically active component in a passive matrix to make a composite material 304 (i.e. magnetic layer which consists of barium ferrite #5 bonded in natsyn® by a matrix process known as plastiform® or a ceramic powder in epoxy) which can be cast or coated on a supporting substrate 306 (See FIG. 8). If the composite product is insulating, a thin relaxation layer in the form of a conductive coating 308 could be applied over the magnetic composite material 304, as shown in FIG. 8, to serve as a development electrode defining the electrostatic fields in the development zone. Alternatively, FIG. 9, a conductive pigment may be added to the composite formulation to provide bulk conductivity allowing development current to flow through the magnetic composite material 304 to the substrate 306 or to a separate collection electrode (not shown). Another alternative shown in FIG. 10 is to form the magnetic layer 314 on the reverse side of a thin substrate 312 that provides a durable conducting surface.

Sleeve 75 has a planar portion 500 thereof in the development zone 112. Planar portion 500 extends the development zone which increases the effective length of the development zone. Preferably, planar portion 500 has a width between 0 to ⅓ the radius of core 400 and is substantially parallel to the imaging surface. Sleeve 75 has portions defining six magnetic zones having a different static magnetic field patterns: load zone 502, trim/meter zone 504; mix/transport zone 506, planar portion zone 500, transport zone 508 and strip zone 510.

Load zone 502 comprises a static magnetic field pattern consisting of a series of parallel lines having a spacing between 2 mm and a width between 2 m. Load zone lines has a strong normal magnetic field as compared to other zones which attracts developer material to form a developer blanket the sleeve creating a developer blanket having a thickness of about 2 mm.

Trim/meter zone 504 comprises a static magnetic field pattern consisting of a series of parallel cross mixing lines having a spacing about 1 mm and a width of about 1 mm. Trim/meter zone 504 has moderate spatial magnetization wavelength and median magnetic strength to limit the developer blanket to an uniform thickness, preferably about 1.5 mm.

Mix/transport zone 506 comprises a static magnetic field pattern consisting of a series of parallel cross mixing lines having a spacing about 1 m and a width of about 1 m. Mix/transport zone 506 has moderate spatial magnetization wavelength and median magnetic strength to homoginize and additional tribo charge as the developer blank moves to the development zone 112. Blanket thickness is about 1.25 mm.

Planar portion zone 500 has the development zone defined therein, planar portion zone 500 comprises a series of parallel lines having a spacing of about 1 mm and a width of about 1 mm. In planar portion 500 has short spatial magnetization wavelength and median magnetic strength to compressed the developer blanket.

Transport zone 508 comprise a series of lines having a spacing of about 1 and a width of about 1. Transport zone 508 has strong spatial magnetization wavelength and median magnetic strength which draws spent developer from the development zone 112. Strip zone 510 has no static magnetic field pattern and allows developer to be released from the sleeve with the aid of gravity back into the housing.

Magnetic assembly 400 is positioned within sleeve 75 extending nearly the full length of the sleeve 75 and being mounted therein by means of suitable shafts (not shown) rotatably supported by end caps. Magnetic assembly 400 has multiple poles has a pole spacing of about 2 to 5 mm. Magnetic assembly 400 is substantial cylinderical in shape. The distance between the outer surface of magnetic assembly 400 and the inner surface of sleeve 75 varies from 0.5 mm to 3 mm. Magnetic assembly 400 and the inner surface of sleeve 75 varies at planar portion from 0.5 mm to 1 mm.

Figure 2:
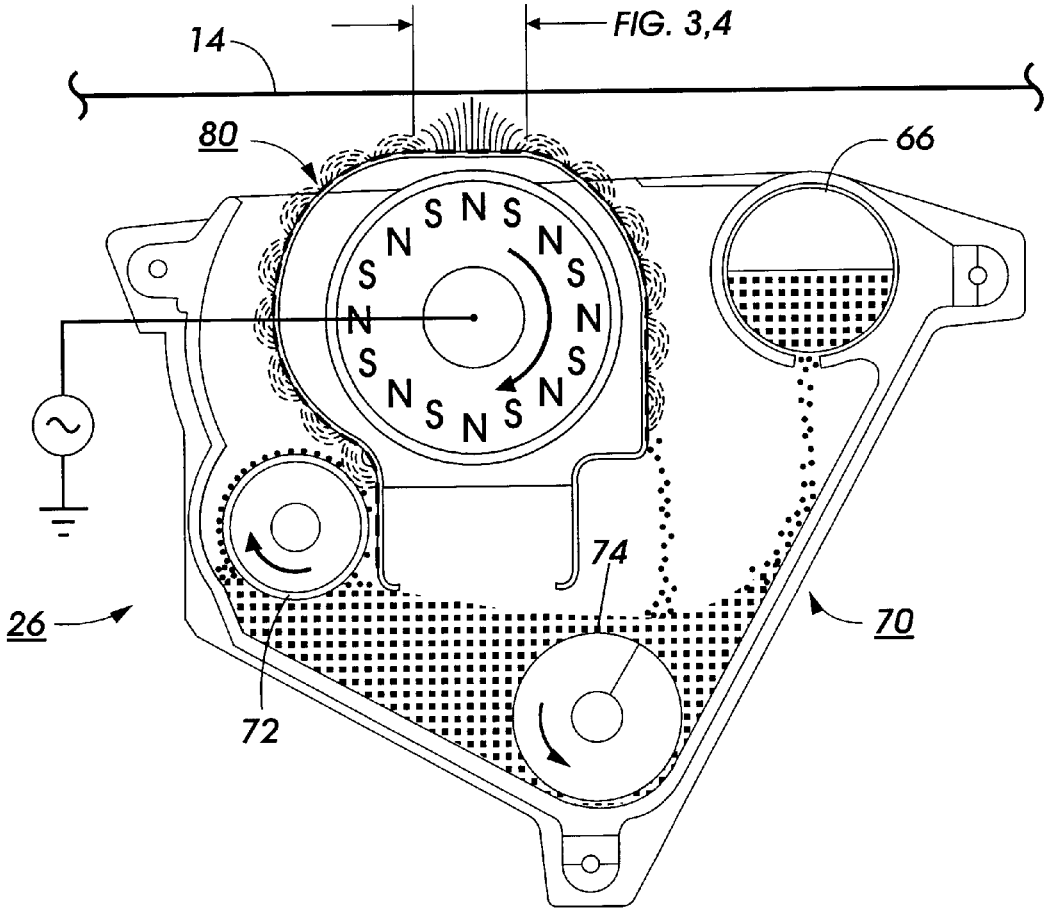
FIG. 2 is an enlarged side view of the developer assembly shown in FIG. 1.
Figure 3:
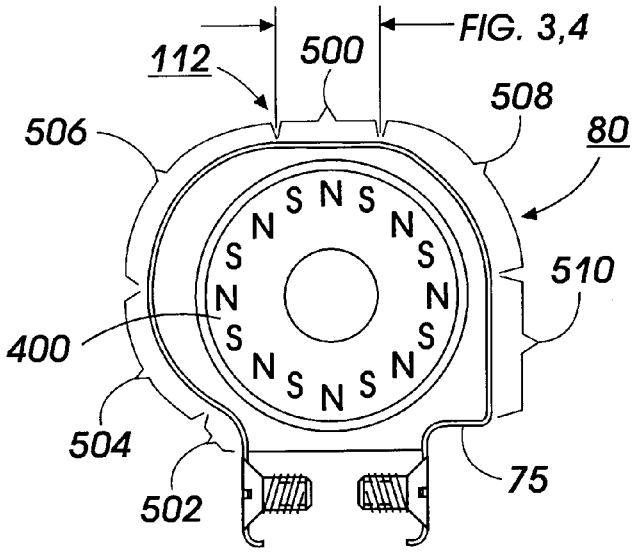
FIG. 3 is an enlarged view of the donor roll of the developer assembly shown in FIG. 2.
Figure 4:
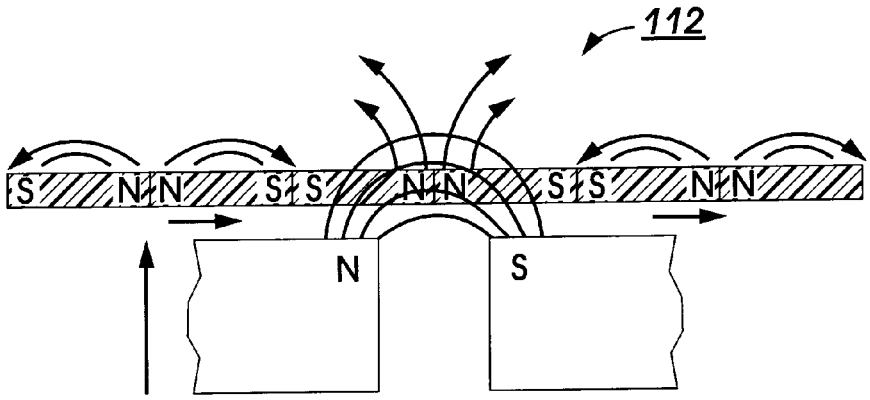
FIG. 4 is an enlarged view of the development area of the developer assembly shown in FIG. 2.
Figure 5:
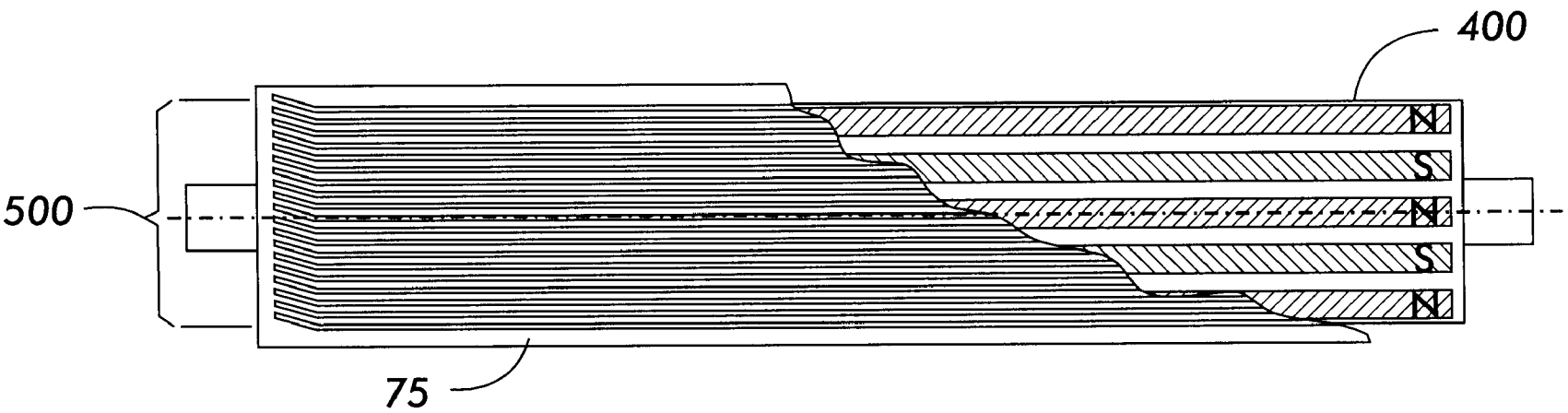
FIG. 5 is an enlarged top view of the donor roll of the present invention.
Figure 6:
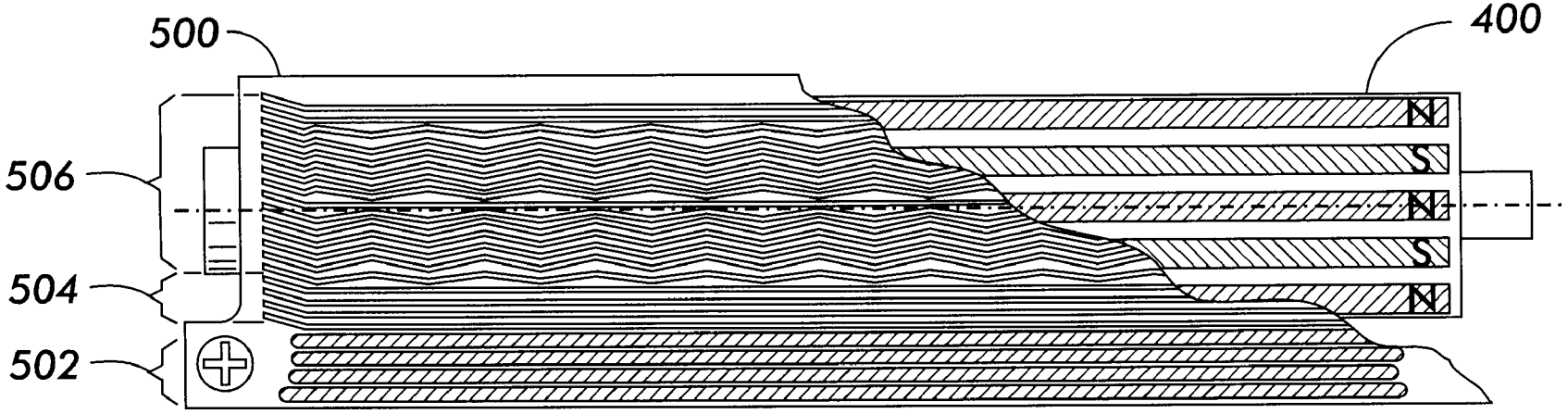
FIG. 6 is an enlarged side view of the donor roll of the present invention.

In operation the stationary magnetically patterned sleeve 75 holds a thin well-defined blanket of magnetic developer on the sleeve surface as shown in FIG. 2. Magnetic assembly rotates and thereby generating a tangential magnetic field to move the developer blanket along the surface of sleeve 75; The developer blanket passes over zones on sleeve where developer material is picked up, self metering, mixing , blanket homoginization, tribo charging and developer transport occurs. The developer blanket moves to the development zone whereupon the blanket is compressed; agitation generated by the rotating magnetic assembly dislodges toner particles from the carrier beads and an AC field is applied to sleeve 75 to aid in the formation of a toner cloud for transport to the photoreceptor image by the development fields.

While the invention has been described with reference to the structures disclosed, it is not confined to the specific details set forth, but is intended to cover such modifications or changes as may come within the scope of the following claims:

What is claimed is:

1. An apparatus for developing a latent image recorded on an imaging surface, comprising:

a housing defining a chamber storing a supply of developer material comprising toner;

a donor members spaced from the imaging surface, for transporting toner on the surface thereof to a region opposed from the imaging surface means for conveying said developer material in said housing and forming a developer blanket onto a reload zone on said surface of said donor member, said donor member including a core having a rotating multiple magnetic assembly;

a stationary transport sleeve, enclosing said core; wherein said core generating a tangential magnetic field to move the developer blanket along the surface of said transport sleeve;

said transport sleeve having a plurality of function zones for modifying said developer blanket, wherein each of said plurality of function zones has a distinct static magnetic field pattern associated therewith.

2. The apparatus of claim 1, wherein one of said plurality of function zones includes said reload zone, said reload zone has a static magnetic field pattern consisting of a series of parallel lines to attract toner to said transport sleeve.

3. The apparatus of claim 2, wherein said series of parallel lines have a spacing 1 to 2 mm from each line and a width between 1 to 2 mm.

4. The apparatus of claim 1, wherein one of said plurality of function zones includes means for trimming/metering said developer material on said transport sleeve, said trimming/metering means including a static magnetic field pattern consisting of a series of parallel cross mixing lines.

5. The apparatus of claim 4, wherein said series of prarllel cross mixing lines have a spacing about 1 mm from each line and a width about 1 mm.

6. The apparatus of claim 1, wherein one of said plurality of function zones includes means for mixing/transporting said developer material on said transport sleeve, said mixing/transporting means including a static magnetic field pattern consisting of a series of prarllel cross mixing lines.

7. The apparatus of claim 6, wherein said series of prarllel cross mixing lines have a spacing about 1 mm from each line and a width about 1 mm.

8. The apparatus of claim 1, wherein one of said plurality of function zones includes means for compressing said developer material on said transport sleeve in a development zone, said compressing means including a static magnetic field pattern consisting of a series of prarllel lines.

9. The apparatus of claim 8, wherein said series of prarllel lines have a spacing about 1 mm from each line and a width about 1 mm.

10. The apparatus of claim 1, wherein said static magnetic field pattern comprises a magnetically active layer coated on the outer surface of a supporting substrate.

11. The apparatus of claim 1, wherein said static magnetic field pattern comprises a magnetically active layer coated on the inner surface of a supporting substrate.

12. The apparatus of claim 1, wherein the static magnetic field has a magnetization direction being predominantly normal with respect to the surface of said transport sleeve.

13. The development system of claim 1, wherein the static magnetic field pattern has a magnetization direction being predominantly parallel to the -surface of said transport sleeve.

* * * * *